US005588365A

United States Patent [19]

Herold et al.

[11] Patent Number: 5,588,365

[45] Date of Patent: Dec. 31, 1996

[54] APPARATUS FOR METERING LIQUID MEDIA IN OFFSET PRINTING MACHINES

[75] Inventors: Manfred Herold, Hainburg; Georg Hartung, Seligenstadt; Hans-Willy Schutz, Freigericht; Ulrich Jung, Limburg, all of Germany

[73] Assignee: MAN Roland Druckmaschinen AG, Germany

[21] Appl. No.: 371,268

[22] Filed: Dec. 23, 1994

[30] Foreign Application Priority Data

Dec. 23, 1993 [DE] Germany ..... 43 44 084.3

[51] Int. Cl.[6] ..... B41F 31/04; B41F 31/06; B41F 3/30

[52] U.S. Cl. ..... 101/350; 101/352

[58] Field of Search ..... 101/349, 380, 101/351, 352, 363, 364, 365, 148, 207–210; 118/258, 259, 261, 263

[56] References Cited

U.S. PATENT DOCUMENTS

| | | | |
|---|---|---|---|
| 2,240,762 | 5/1941 | Dietrich | 101/350 |
| 2,374,096 | 4/1945 | Heywood et al. | 101/153 |
| 4,308,796 | 1/1982 | Satterwhite | 101/352 X |
| 5,003,876 | 4/1991 | Harrison | 101/350 |
| 5,081,928 | 1/1992 | Harrison | 101/351 |
| 5,154,602 | 10/1992 | Harrison | 101/351 |

FOREIGN PATENT DOCUMENTS

| | | |
|---|---|---|
| 0071180A1 | 7/1982 | European Pat. Off. . |
| 3324096C2 | 10/1986 | Germany . |
| 3941571A1 | 6/1990 | Germany . |
| 3906646A1 | 10/1990 | Germany . |

*Primary Examiner*—J. Reed Fisher
*Attorney, Agent, or Firm*—Leydig, Voit & Mayer, Ltd.

[57] ABSTRACT

The invention relates to an apparatus for the metering of liquid media, especially varnish, of differing viscosity in an offset printing machine. Exchangeable metering subassemblies are assigned to a form cylinder. The first metering subassembly provided for processing low-viscosity media consists of a reservoir, a dipping roller, a metering roller and the form cylinder. The second metering subassembly for processing higher-viscosity media consists of a chamber doctor, a screened applicator roller and the form cylinder. In a further version, both metering subassemblies are assigned permanently to the form cylinder. Depending on the media to be processed, the necessary subassemblies are engaged with the form cylinder and the other subassembly is disengaged from the form cylinder.

8 Claims, 3 Drawing Sheets

APPARATUS FOR METERING LIQUID MEDIA IN OFFSET PRINTING MACHINES

FIELD OF THE INVENTION

The invention relates generally to offset printing machines, and more specifically to an apparatus for metering liquid media of differing viscosity in offset printing machines. The invention preferably meters liquid media to be applied to a printing material in varnishing units. The apparatus is suitable for processing low-viscosity media (≦50 s run-out time, 4 mm cup), for example, dispersion varnish on an aqueous base, or for the processing of higher-viscosity media (>50 s run-out time, 4 mm cup), for example, bronze or fancy printing ink with a specific pigment fraction, such as gold varnish.

BACKGROUND OF THE INVENTION

Various solutions are known for metering liquid media. According to DE 3,324,096 C2, the medium to be applied, in particular, varnish, is metered using a reservoir, a rotating dipping roller, a metering roller, a varnishing cylinder and an impression cylinder. According to DE 3,941,571 A1, a doctor blade can also be assigned to the dipping roller.

EP 0,071,180 A1 discloses a chamber doctor formed essentially by a housing with side walls to which doctor blades, or doctor knives, are fastened. The doctor blades are supported on the applicator roller and the liquid is transferred onto the screened applicator roller via the chamber. The chamber doctor is mounted pivotably in a mounting arranged above the applicator roller and can be advanced onto the applicator roller by means of a working cylinder acting on the mounting.

A disadvantage of these solutions is that, in the case of media having differing viscosity, they do not guarantee an exact metering (that is, production of a specific layer thickness) of the medium to be applied. Therefore, these solutions cannot be used universally to apply onto printing material, media having differing viscosities.

An applicator for printing machines, which is suitable for high-viscosity and low-viscosity media, is disclosed in DE 3,906,648 A1. Metering takes place essentially by means of a profiled scoop roller, doctor blade, transfer roller, smoothing roller or applicator roller, and a form cylinder having cups and a doctor blade.

These versions are complicated in terms of construction, especially when smoothing rollers are used. An object of the invention, therefore, is to develop a solution which eliminates these disadvantages.

OBJECTS AND SUMMARY OF THE INVENTION

According to the invention, a selectively exchangeable metering system is employed according to the particular instance of use. The invention allows the quick change of a dipping roller/metering roller (first subassembly) and a chamber doctor with an applicator roller (second subassembly). In a further version, the first and second subassemblies can also be installed so as to be assigned permanently to the form cylinder.

In processing low-viscosity media (≦50 s run-out time, 4 mm cup), the subassembly is employed which comprises a dipping roller and a metering roller, each with a different surface hardness. The two rollers can alternately have an elastomeric covering or be designed as a steel roller. The harder of the two rollers has a smooth metal surface or a screened surface. In the processing of higher-viscosity media (>50 s run-out time, 4 mm cup), the second subassembly is employed, which comprises a chamber doctor and a screened applicator roller. The appropriate metering is obtained by means of the negatively engaged doctor blade of the chamber doctor and the screen structure of the applicator roller. A variation in the metered quantity is possible, for example, by exchanging the screened applicator roller and using a new roller with a varied screen structure.

The advantage of this solution is that the selective exchange of the subassemblies guarantees an exact layer thickness for media having a low and higher viscosity range. A further advantage is that, when processing low-viscosity media, the metering roller and the dipping roller can be designed to be interchangeable. The different surface hardness makes it possible, even without the use of the chamber doctor, to obtain a variable metering range when applying low viscosity fluids. In the version already described with two subassemblies assigned permanently to the form cylinder, each can be engaged and disengaged from the form cylinder.

The apparatus can precede the first printing group of an offset printing machine for print finishing (for example, varnishing or applying a covering layer), be arranged between the printing groups, or follow the printing groups. The solution according to the invention is suitable for spot varnishing (reserve varnishing), and for full-surface varnishing. The apparatus according to the invention can also be preceded or followed by a further finishing apparatus, for example, a further varnishing unit for full-surface varnishing, or a laminating or embossing apparatus.

By means of the apparatus according to the invention, a larger range of viscosity can be correctly metered in the desired layer thickness on an applicator roller.

While the invention will be described in connection with certain preferred embodiments, there is no intent to limit it to those embodiments. On the contrary, the intent is to cover all alternatives, modifications, and equivalents included within the spirit and scope of the invention as defined by the appended claims.

BRIEF DESCRIPTION OF THE PREFERRED EMBODIMENTS

Figure 1:
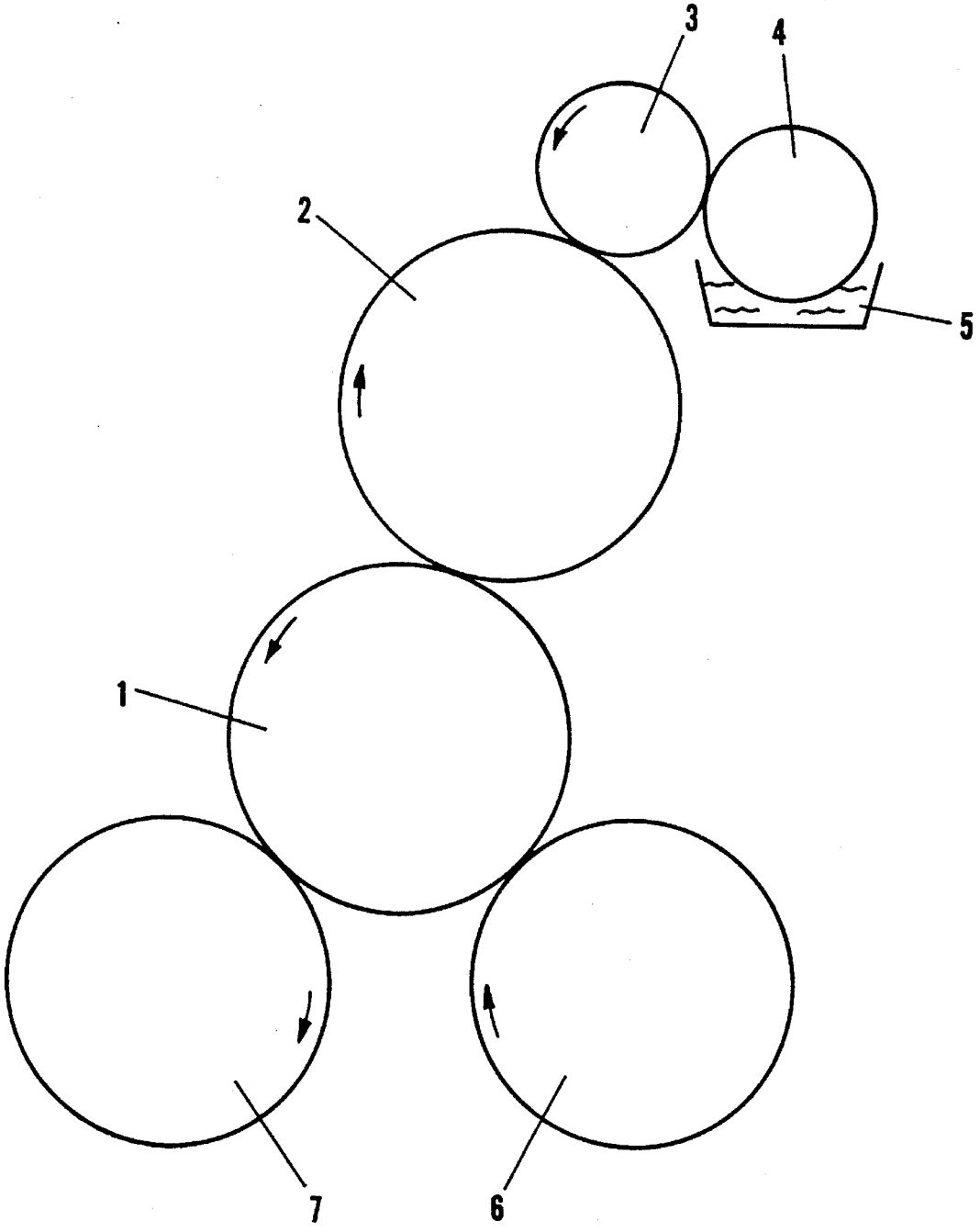
FIG. 1 shows a metering apparatus subassembly for low-viscosity media incorporating teachings of the invention.

In an offset printing machine, the apparatus according to the invention follows the last printing group and provides in-line varnishing of printing materials. The apparatus consists of a sheet-guiding cylinder 1, to which a form cylinder 2 with a fastened transfer form is assigned. FIG. 1 shows a first subassembly for metering low viscosity varnishes (≦50 s run-out time, 4 mm cup). The form cylinder 2 is in contact with a metering roller 3, by means of which the varnish to be processed is metered. the metering roller 3 is in contact with a dipping roller 4. The dipping roller 4 runs in a reservoir 5 filled with varnish. The metering roller 3 is coupled to a drive (not shown). The two rollers 3, 4 have different surface hardnesses. The thickness of the layer transferred between the metering roller 3 and the form cylinder 2 is dependant upon the principle of ink splitting. Under a specific adjusting force, a thinner layer is transferred onto the form cylinder 2 when a harder metering roller 3 is utilized, and a thicker layer is transferred onto the form cylinder 2 when a softer metering roller 3 is used.

Figure 2:
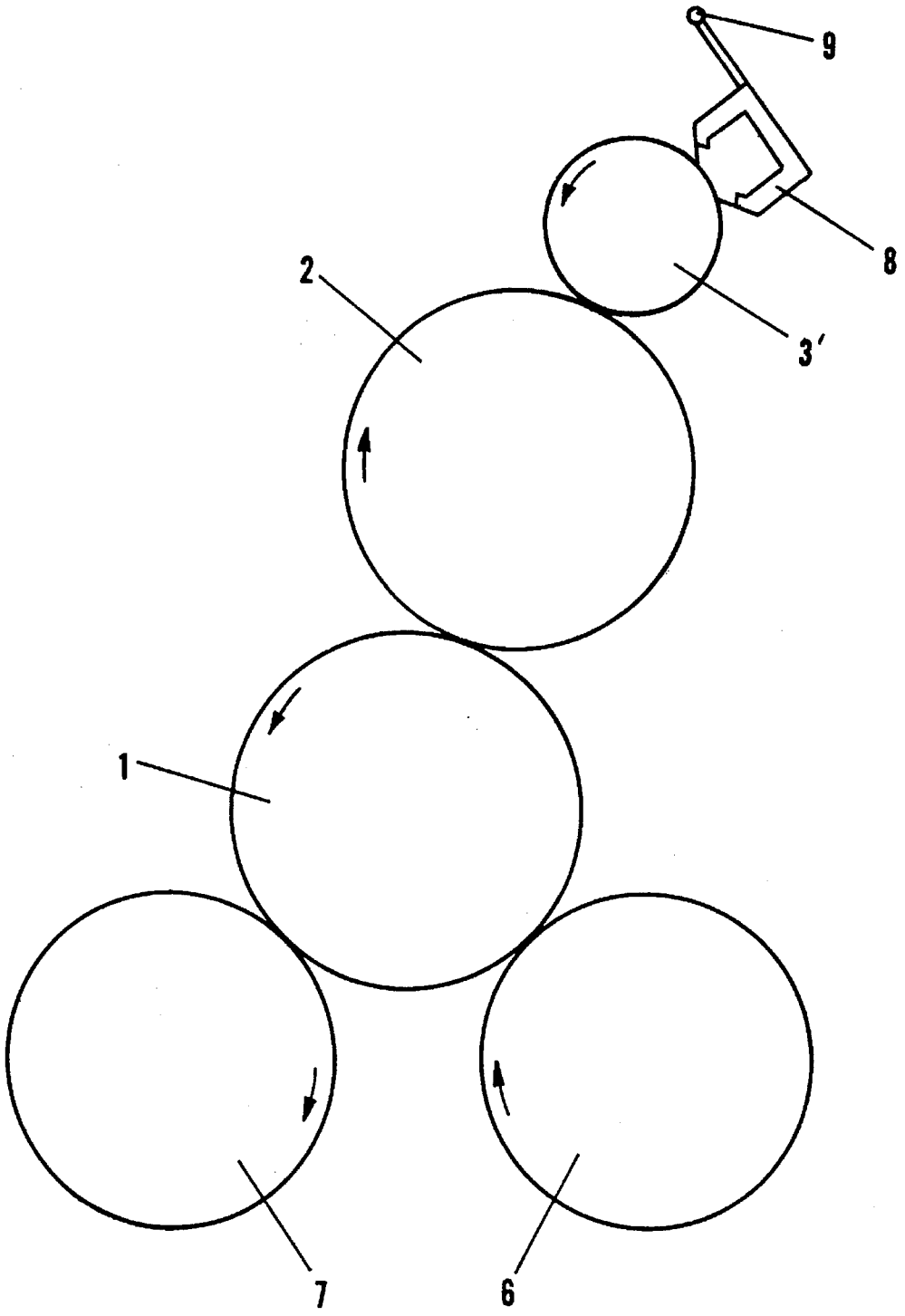
FIG. 2 shows a metering apparatus subassembly for higher-viscosity media incorporating teachings of the invention.

Referring now to FIG. 2, there is shown the second subassembly for metering higher viscosity varnishes (>50 s run-out time, 4 mm cup). The metering roller 3 and dipping roller 4 are exchanged for a screen roller 3' (for example, a ceramic roller), and a chamber doctor 8. The chamber doctor 8 comprises a housing which is rotatable about a pivot bearing 9 and is supported by doctor blades along the circumference of the screen roller 3'. One doctor blade seals off the chamber relative to the screen roller 3' as a positively engaged closing doctor. The other doctor blade meters the fluid media as a negatively engaged working doctor. The housing of the chamber doctor 8 is rotatable about the pivot bearing 9, which is arranged on the side frames, and can be adjusted relative to the screen roller 3'. The chamber doctor 8 comprises a device, which will not be described further here, for feeding and discharging the particular medium to be processed.

The mode of operation of the apparatus is as follows:

When a low-viscosity varnish is to be processed, the dipping roller 4 and the metering roller 3 are assigned to the form cylinder 2, as shown in FIG. 1. The metering roller 3 may be provided with a relatively hard surface and can possess a smooth or screened surface, while the dipping roller 4 may be provided with a softer surface, such as an elastomeric covering. The low-viscosity liquid medium or varnish to be processed is conveyed to the metering roller 3 by the dipping roller 4 via the reservoir 5, so that a varnish film forms on the metering roller 3. The metering roller 3 may be adjusted relative to the dipping roller 4 or to the form cylinder 2. Metering takes place on the scoop-roller principle; the metering roller 3 conveys the varnish to the form cylinder 2 which transfers the varnish onto the printing material in conjunction with the impression cylinder 1.

When a higher-viscosity varnish is to be processed, the dipping roller 4 is removed, and the dipping roller 4 and the metering roller 3 are replaced by a chamber doctor 8 and a screen roller 3' as shown in FIG. 2 The chamber doctor 8 is received on the pivot bearing 9. Application of the varnish is now metered by means of the negatively engaged working doctor blade and the screen structure of the applicator roller 3'. The variation in the meterable varnish quantity is possible as a result of the exchange of the screen roller 3' in that a screen roller 3' employed has a varied screen structure.

Figure 3:
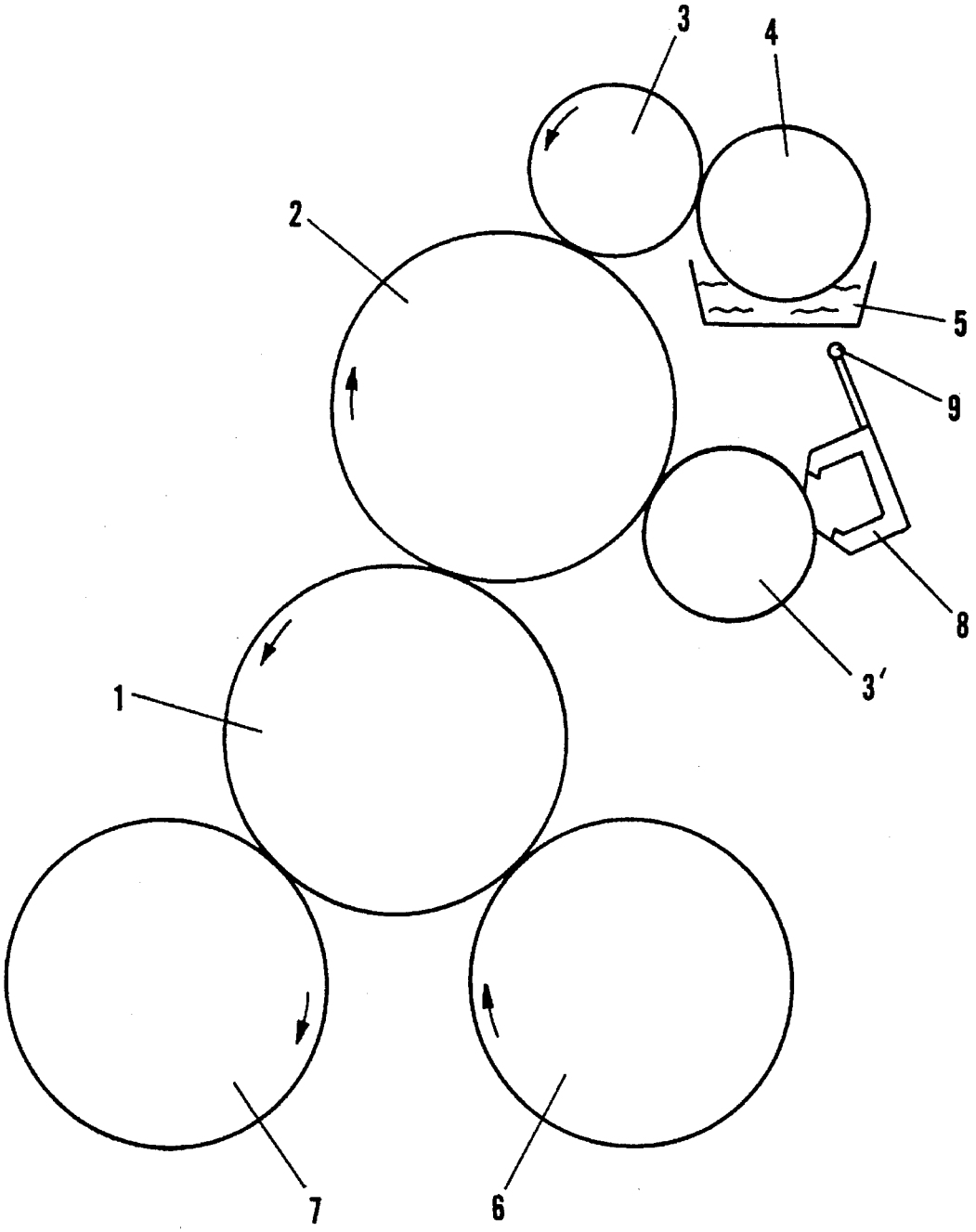
FIG. 3 shows an offset printing machine with a form cylinder having separate liquid media supply subassemblies located at different locations with respect to the form cylinder.

In an alternate embodiment, as depicted in FIG. 3 a selectively engageable metering roller 3 with a dipping roller 4 and reservoir 5 is assigned as a first subassembly to the form cylinder 2, and a screen roller 3' with a chamber doctor 8 is assigned as a second subassembly preferably to the first and/or second quadrant of the form cylinder 2. When a low viscosity media is to be processed, the first subassembly (metering roller 3, dipping roller 4) is brought into contact with the form cylinder 2. When a higher viscosity media is to be used, the second subassembly in brought into contact with the form cylinder 2 by engaging the screen roller 3'. The chamber doctor 8 is mounted, for example, on a pivot bearing 9 and rests with the doctor blades on the outer surface of the form cylinder 2. At the same time, the chamber doctor 8 can be mounted on a crosspiece (not shown) fixed relative to the frame and can be selectively engaged relative to the screen roller 3' by this crosspiece.

We claim as our invention:

1. An offset printing machine comprising an impression cylinder, a form cylinder, a first liquid media supply subassembly located at a first location adjacent the form cylinder, said subassembly including a metering roller, a dipping roller, said metering roller being in contact with said dipping roller, said metering roller and said dipping roller having different surface hardnesses, and a reservoir containing a first liquid media of determined viscosity, said dipping roller being rotatable within the reservoir such that the first liquid media is transferred to the surface of the dipping roller, said first subassembly being selectively movable between an inoperative position in which said metering roller is in disengaged relation to the form cylinder and an operative position in which said metering roller is in contacting engagement with said form cylinder for supplying said first liquid media to said form cylinder, a second liquid media supply subassembly located at a second location adjacent said form cylinder different from said first location, said second subassembly comprising a screen applicator roller, a chamber doctor comprising at least one doctor blade supported along the circumference of the screen applicator roller, and a supply of a second liquid media of higher viscosity than said first liquid media, said second supply supplying liquid to the surface of the screen applicator roller, the chamber doctor metering the application of the second liquid media to the screen applicator roller, said second subassembly being selectively movable between an inoperative position in which said screen applicator roller is out of contact with said form cylinder and an operative position in which said screen applicator roller contacts said form cylinder at a location different from the location of contact of the metering roller of said first subassembly, said second subassembly supplying the second liquid media to the form cylinder when said second subassembly is in the operative position and said first subassembly is in the inoperative position.

2. The printing machine as claimed in claim 1 wherein said first liquid media has less than or equal to a 50 second run-out time for a 4 mm cup.

3. The printing machine as claimed in claim 1 wherein said second liquid media has greater than a 50 second run-out time for a 4 mm cup.

4. The printing machine as claimed in claim 2 wherein said second liquid media has greater than a 50 second run-out time for a 4 mm cup.

5. The printing machine as claimed in claim 1 wherein said chamber doctor further comprises a housing which is rotatable about a pivot bearing, said pivot bearing being arranged on side frames of said printing machine and being adjustable relative to the screen applicator roller.

6. The printing machine as claimed in claim 1 wherein said first location is in a first quadrant of the form cylinder, and said second location is in a second quadrant of the form cylinder different from said first quadrant.

7. The printing machine as claimed in claim 1 wherein the printing machine is a lacquering unit.

8. The printing machine as claimed in claim 1 wherein the printing machine is a varnishing unit.

* * * * *